US007147288B2

(12) United States Patent
Grasse et al.

(10) Patent No.: US 7,147,288 B2
(45) Date of Patent: Dec. 12, 2006

(54) BACKREST

(75) Inventors: Klaus-Peter Grasse, Waldshut-Tiengen (DE); Manfred Schlegel, Waldshut-Tiengen (DE); Mathias Seiler, Loerrach (DE)

(73) Assignee: Sedus Stoll AG, Waldshut-Tiengen (DE)

( * ) Notice: Subject to any disclaimer, the term of this patent is extended or adjusted under 35 U.S.C. 154(b) by 341 days.

(21) Appl. No.: 10/759,195

(22) Filed: Jan. 20, 2004

(65) Prior Publication Data

US 2004/0195899 A1 Oct. 7, 2004

(30) Foreign Application Priority Data

Feb. 16, 2003 (EP) ..... 03003522

(51) Int. Cl.
*A47C 7/40* (2006.01)

(52) U.S. Cl. ..... 297/452.2; 297/452.18; 297/301.1

(58) Field of Classification Search ..... 297/284.4, 297/300.1, 300.4, 301.1, 301.3, 452.18, 452.19, 297/452.2

See application file for complete search history.

(56) References Cited

U.S. PATENT DOCUMENTS

| | | | | |
|---|---|---|---|---|
| 5,810,438 | A | 9/1998 | Newhouse | |
| 6,113,186 | A * | 9/2000 | Holmes et al. | 297/248 |
| 6,550,866 | B1 * | 4/2003 | Su | 297/452.42 |
| 6,669,292 | B1 * | 12/2003 | Koepke et al. | 297/300.2 |
| 6,843,530 | B1 * | 1/2005 | Wu | 297/284.4 |
| 6,945,601 | B1 * | 9/2005 | Wu | 297/284.4 |
| 2003/0151287 | A1 * | 8/2003 | Ueda et al. | 297/301.1 |

FOREIGN PATENT DOCUMENTS

| | | |
|---|---|---|
| DE | 91 02 086 | 6/1992 |
| DE | 100 48 779 A1 | 4/2002 |
| EP | 0 308 538 A1 | 3/1989 |
| EP | 0 935 934 A2 | 8/1999 |
| EP | 1 192 882 | 3/2002 |
| GB | 844819 | 8/1960 |
| WO | WO 02/098261 | 12/2002 |

* cited by examiner

*Primary Examiner*—Peter R. Brown
(74) *Attorney, Agent, or Firm*—Oblon, Spivak, McClelland, Maier & Neustadt, P.C.

(57) ABSTRACT

The backrest of a chair comprises a frame, a backrest support and a neck support. A membrane is clipped into the frame, and the backrest support is articulated on a tilting mechanism. The frame comprises two side parts and two cross-pieces, the lower cross-piece lying at the height of the user's lumbar vertebra. The frame and the backrest support are interconnected in one piece. The component created as a result is advantageously a plastic injection molding produced by the gas injection technique (GIT) and the plastic is a glass-fiber-reinforced polyarylamide. This overall structure of the backrest provides a high level of sitting comfort by elastic support of the back in all major regions and directions of movement, but at the same time also considerably reduces production, transport and assembly complexity and has an aesthetically impressive, distinctive form.

5 Claims, 3 Drawing Sheets

BACKREST

TECHNICAL FIELD

The invention relates to the field of seating furniture, in particular a backrest for an office chair, in which a membrane is clamped in a frame.

PRIOR ART

It is known in the case of office chairs to attach the backrest to the backrest support in such a way that it is able to follow as far as possible all the movements of the user's back. In technical terms, this means that the backrest is cardanically mounted, that is to say is movable about the three spatial axes. Consequently, it can follow sagittal movements of the back, that is movements about a horizontal axis parallel to the body, but also torsional movements and transversal movements, that is movements about the vertical axis and about a horizontal axis perpendicular to the body. Such combined upper body movements in three directions occur very frequently in practice, for example when reaching down sideways into the drawer of a desk, or when turning towards another person during conversation. Cardanic bearings for backrests on chairs are also referred to as "dorsokinetically flexible joints".

A chair of the type described is known for example from EP 0308538 A. In the case of this known chair, the cardanic mounting is achieved by the backrest having a spherical segment-shaped formation, which is mounted in a second spherical segment-shaped formation on the backrest support. The center point about which the backrest can move lies on the surface of the padding. Laterally and above and below the cardanic joint, spring elements are provided between the backrest and the backrest support, for example elastic polyester elements, which exert spring forces both perpendicularly and parallel to the surface of the backrest.

Although this known chair offers outstanding sitting comfort, there is a certain degree of complexity involved in its production.

Another chair with a cardanically mounted backrest is known from EP 0935934 A. The cardanic mounting is achieved there by means of a circular-cylindrical elastomeric element, or the two end faces of which there is respectively vulcanized a steel plate, which is connected to the backrest and the backrest support by screws. The user can consequently move the backrest against the spring forces of the elastomeric element. In addition, the backrest support can also be pressed rearwards against a recovery spring. On its user surface, the padding is in principle made to be rigid and is bent in the region of the rubber bearing.

Although this known chair has the advantage that the cardanic bearing comprises fewer individual parts, and can consequently be produced at lower cost, the conventional design of the user surface of the backrest padding does not achieve optimum support for the user's back. Furthermore, the articulation of the backrest support on the chair pedestal and the attachment to a recovery spring is also very complex and consequently costly. Finally, it is also disadvantageous that the elastomeric bearing does not offer any protection against breaking away; if the plates vulcanized onto the elastomeric element become detached, the backrest falls off the backrest support.

Another chair of the type stated is known from DE 100 48 719 A1: in the case of this chair, the backrest is formed as a frame with a membrane clamped in it. The frame comprises two essentially vertically running side parts, and an upper and lower cross-piece, connecting the two side parts. At the lower cross-piece, the frame is suspended by means of a dorsokinetically flexible joint on the upper part of a backrest support, which consists of aluminium and is articulated with its fork-shaped lower part on the tilting mechanism.

Although this chair offers a very high degree of sitting comfort, it is also relatively complex in technical production terms, and can also still be further optimized with regard to the dorsokinetic support of the lumbar lordosis.

Finally, U.S. Pat. No. 5,810,438 A also discloses a chair, in which the back part, the seat part and the two armrests are interconnected in one piece. Provided as an option between the seat and the backrest is a spring part, which is likewise connected in one piece to the seat and backrest. The known chair is an injection molding and is produced by the gas injection technique (GIT).

SUMMARY OF THE INVENTION

It is therefore the object of the invention to develop a backrest of the type described in DE 100 48 779 A1 in such a way that on the one hand it offers the user's back optimum support in the case of all possible movements, whether sagittal, transversal or torsional, but on the other hand it can nevertheless be produced at low cost, in particular requires minimal production complexity fox large numbers of units. Nevertheless, a high level of stability of the construction in tough everyday use is of course also to be ensured. Finally, the backrest according to the invention is also intended to represent an optimum solution aesthetically, from the criteria of industrial design. This object is achieved by the features of claim 1 and of the subclaims.

The essence of the invention is the idea of connecting the frame to the backrest support in one piece, that is of making the frame and the backrest support as a one-piece component, the two legs of the backrest support running together in a connecting piece, and the connecting piece running smoothly and uninterruptedly into the lower cross-piece of the frame. This component takes the form of an injection molding made of a glass-fiber-reinforced polyamide resin, preferably a polyarylamide, and is produced by the gas injection technique (GIT), allowing largely hollow individual parts to be produced. The construction according to the invention achieves the effect that the backrest on the one hand allows the membrane to develop optimal supporting forces for the user's back, but on the other hand brings about a cardanic-elastic connection between the backrest and the backrest support in an elegant and technically low-cost way.

The invention also makes it possible to form the backrest together with the backrest support as a visible part, that is without any special covering, which not only reduces the number of individual parts, and consequently the production complexity, but also produces a distinctive form and creates a high recognition value.

The number of structural elements of the backrest according to the invention is also reduced to a minimum, and consequently keeps down the production complexity. Largely hollow plastic parts achieve the effect of a very low weight. At the same time, however, the backrest according to the invention nevertheless has a most particularly high degree of stability, since breaking away of the backrest from the support under the effect of force is obviously no longer possible because of the one-piece configuration. Furthermore, the backrest according to the invention with the chosen dimensioning and the chosen plastic has a very high level of rigidity and resistance to mechanical stress.

In comparison with the dorsokinetically flexible suspension of the backrest on an aluminium support, the backrest according to the invention has the further advantage that ergonomically desired elastic supporting forces for the user's back are also provided by the backrest support, while the aluminium support is rigid.

BRIEF DESCRIPTION OF THE DRAWINGS

The invention is explained in more detail below on the basis of an exemplary embodiment represented in the drawings, in which.

WAYS OF IMPLEMENTING THE INVENTION

Figure 1:
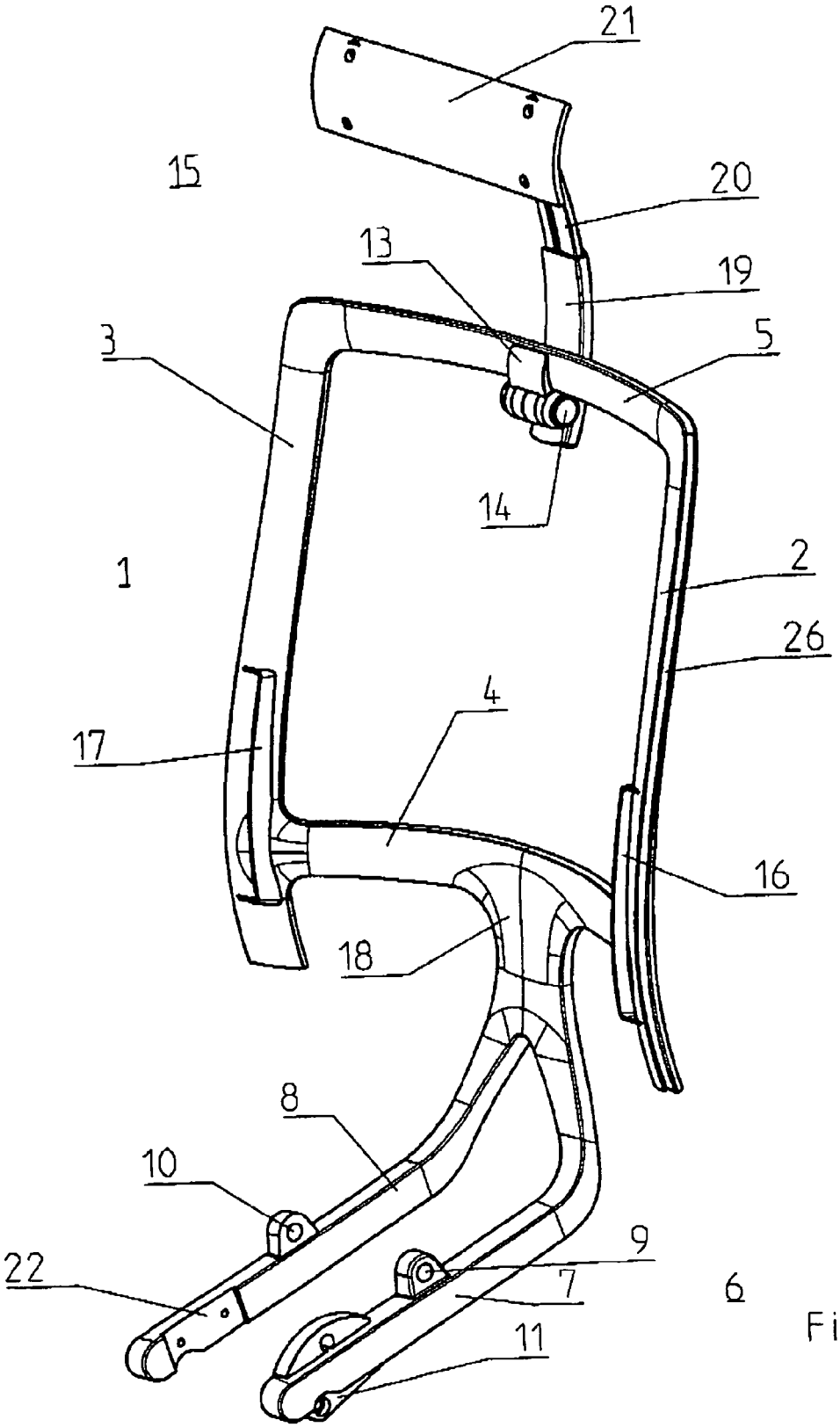
FIG. 1 shows the perspective view from the front of a backrest according to the invention with an assembled bearing for the neck support.
Figure 2:
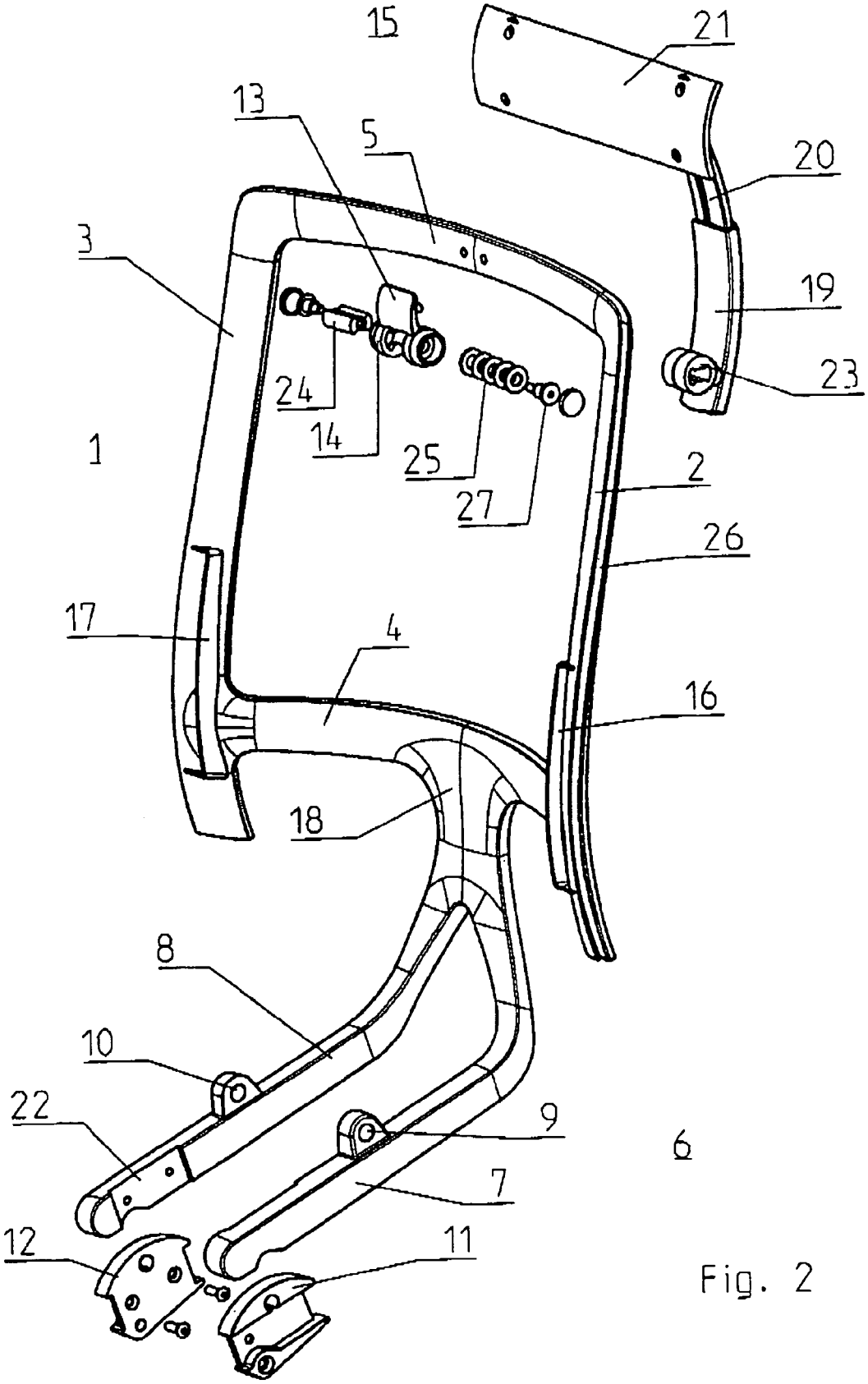
FIG. 2 shows the same view as FIG. 1, but with the attachment of the neck support in an exploded representation.
Figure 3:
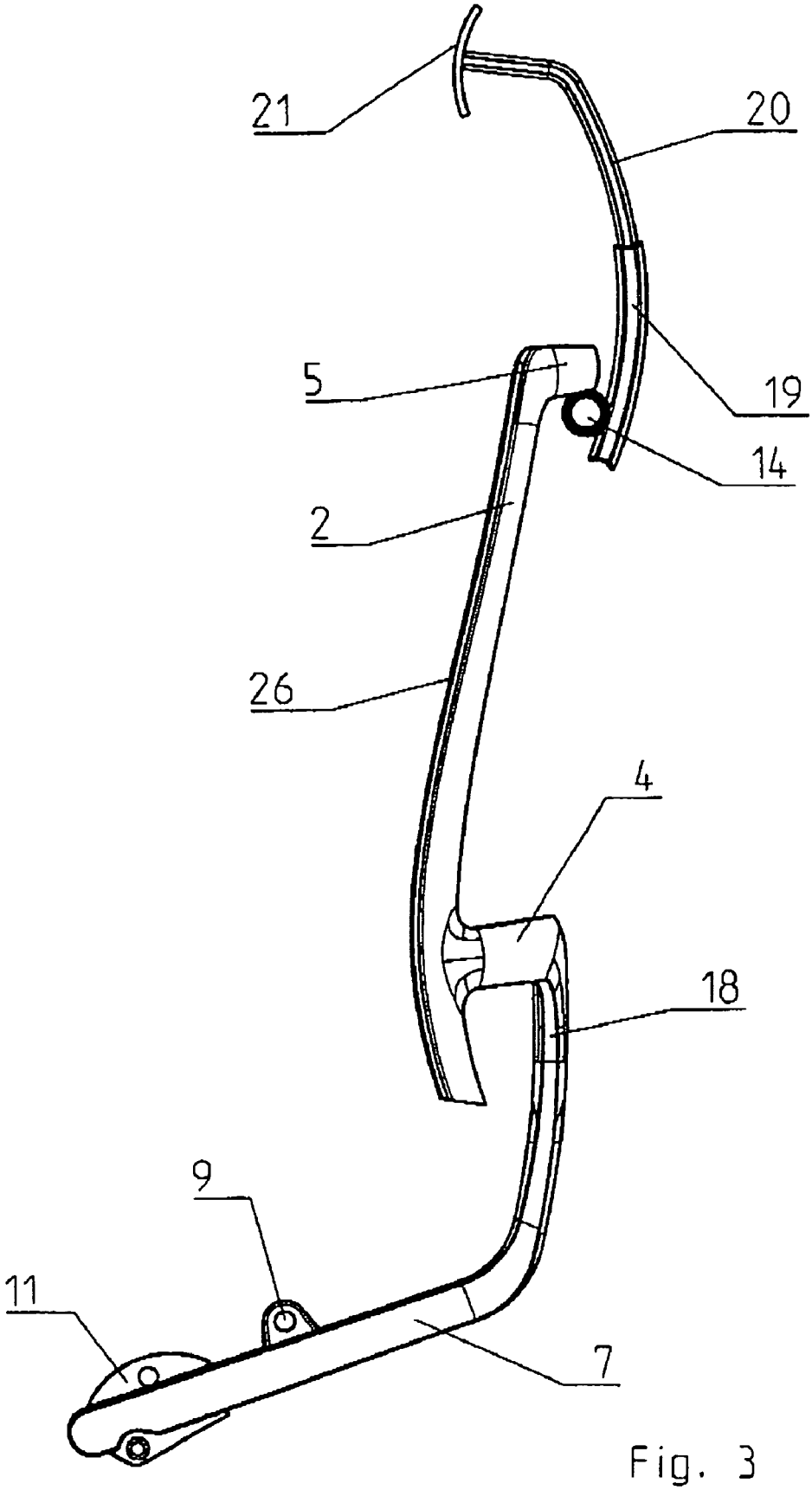
FIG. 3 shows a side view of the backrest represented in FIGS. 1 and 2.

Represented in the figures is a backrest according to the invention, which comprises the frame 1, the backrest support 6 and the neck support 15.

The frame 1 comprises the left-hand side part 2 and the right-hand side part 3. These two side parts 2, 3 are interconnected by means of the lower cross-piece 4 and the upper cross-piece 5.

The side parts 2, 3 have on the outside a groove 26, into which a membrane (not depicted) consisting of an elastic fabric is clipped with its welt-enclosed side edges.

Also provided are strip-shaped holders 16, 17, which are molded on the side parts 2, 3 and into which a band can be clipped as a special lordosis support.

The backrest support 6 comprises the left-hand leg 7 and the right-hand leg 8, which run together in a fork-shaped manner in the connecting piece 18. The connecting piece 18 runs smoothly and uninterruptedly into the lower cross-piece 4. At the front, the legs 7, 8 have bearing blocks 9, 10, on which the rear part of the seat panel (not depicted) is mounted. Right at the, front, the legs 7, 8 have recesses 22, in which metal fittings 11, 12 are inserted and firmly screwed. By means of these fittings 11, 12, the backrest support 6 is articulated on the tilting mechanism (not depicted) of the chair. The mechanism described in DE 196 40 564 A, with synchronous control of the seat and backrest, may be used for example as such a tilting mechanism.

Fastened by means of screws in the middle of the upper cross-piece 5 is a metal fitting 13 with a bearing 14 for the neck support 15. The neck support 15 is pivotably mounted in the bearing 14 by means of the complementary bearing part 23 on the sleeve 19. The pivotability is brought about to a predetermined degree by the sliding block 24, which can move in the suitably shaped inner part of the bearing 23. By means of the cup springs 25, which are under the effect of the screw 27, a frictional force is produced on the bearing 23, making it possible for the neck support to be pivoted but then fixed in a desired position. The neck support 15 can be adjusted in height by moving the bar 20 in the sleeve 19. The head cushion (not depicted) is fastened on the supporting plate 21.

The plastic moldings of the backrest are largely hollow. Only in the middle part of the upper cross-piece 5 and in the lower parts of the two legs 7, 8 of the backrest support 6 is the molding compound compact. This is expedient to allow the screws for the fittings 11, 12 and 13 to have a firm hold.

By contrast with the backrest known from DE 100 48 779 A1, in the case of the backrest according to the invention that is described here the leaning force produced by the user is absorbed not only by the backrest frame but also by the backrest support that is molded on in one piece. This increases the dorsokinetic supporting function of the backrest in an advantageous way.

The polymer compound used is a glass-fiber-reinforced thermoplastic resin based on polyarylamide, preferably the material sold by the company Solvay S.A. under the name IXEF 1022 or 1032.

The moldings are produced by the gas injection technique (GIT), the molten molding compound being forced onto the mold wall by an inert gas, preferably nitrogen, injected under high pressure into the cavity of the injection mold.

The production of the backrest together with the molded-on backrest support by means of the injection-molding technique described is obviously of inestimable value in the production of large numbers of units with regard to the production and assembly complexity. As the exemplary embodiment discussed convincingly shows, the backrest according to the invention has all the advantages required by the object: it brings about outstanding sitting comfort by optimum support of the back, can be produced, transported and assembled with considerably reduced complexity in comparison with the prior art, and from the aspect of industrial design offers a high level of aesthetics and distinctiveness of form.

The invention claimed is:

1. A backrest for a chair, which comprises:

a frame with a membrane clamped therein, the frame comprising two lateral, essentially vertically running side parts and two essentially horizontally running upper and lower cross-pieces, connecting the side parts, the upper cross-piece interconnecting the two side parts at upper ends thereof, and the lower cross-piece interconnecting the two side parts, and the frame being suspended in the middle of the lower cross-piece on a backrest support comprising first and second legs under the seat, wherein:

the backrest support is connected to the frame in one piece, the frame and the backrest support connected thereto in one piece comprises an injection molding made of a glass-fiber-reinforced polyamide resin, preferably a polyarylamide, the molding is hollow apart from the central region of the upper cross-piece and the first and second legs of the backrest support, and the first and second legs of the backrest support run together in a connecting piece, and the connecting piece runs smoothly and uninterruptedly into the lower cross-piece of the frame.

2. A backrest according to claim 1, wherein on the two legs of the backrest support there is respectively provided a molded-on bearing block for the mounting of a seat panel of the chair, and in a front region recesses for receiving fittings for connection to the tilting mechanism, and wherein a fitting which is fastenable with a bearing for receiving a neck support, is provided in a middle portion of the upper cross-piece.

3. A backrest according to claim 2, wherein in the bearing at the fitting on the upper cross-piece, an extendable sleeve is pivotably mounted, in which a bar, on which a supporting plate of the head cushion of the neck support is fastened, is provided.

4. A backrest according to claim 1, which comprises strip holders in which a band is fastenable for supporting the lordosis of the user's lumbar spines, are provided on the side parts of the frame at a height of the lower cross-piece.

5. A method for producing a backrest according to claim 1, which comprises producing the molding by a gas injection technique.

* * * * *